US005848824A

United States Patent [19]

Mocur

[11] Patent Number: 5,848,824

[45] Date of Patent: Dec. 15, 1998

[54] WHEELCHAIR SEAT AND BACKREST CONSTRUCTION

[76] Inventor: Paul Mocur, 12985 Wayne Rd., Livonia, Mich. 48150

[21] Appl. No.: 858,435

[22] Filed: May 19, 1997

[51] Int. Cl.[6] ..... A47C 7/00

[52] U.S. Cl. ..... 297/440.2; 297/338; 297/DIG. 4; 297/354.12

[58] Field of Search ..... 297/452.2, 452.55, 297/440.2, 338, 354.12, 378.12, 380, 440.15, 440.22, 463.1, DIG. 4; 403/362, 344

[56] References Cited

U.S. PATENT DOCUMENTS

| | | | |
|---|---|---|---|
| 3,351,383 | 11/1967 | Richardson | 297/452.55 |
| 3,806,267 | 4/1974 | Vining, Jr. | 403/362 |
| 4,629,246 | 12/1986 | Fulton | 297/440.22 X |
| 5,035,467 | 7/1991 | Axelson et al. | 297/440.22 |
| 5,062,677 | 11/1991 | Jay et al. | 297/440.2 |
| 5,074,620 | 12/1991 | Jay et al. | 297/338 X |
| 5,127,709 | 7/1992 | Rubenstein et al. | 297/440.2 |
| 5,211,446 | 5/1993 | Jay et al. | 297/444 |
| 5,524,971 | 6/1996 | Jay et al. | 297/383 |
| 5,551,756 | 9/1996 | Gurasich et al. | 297/338 X |
| 5,556,168 | 9/1996 | Dinsmoor, III et al. | 297/440.2 |
| 5,683,201 | 11/1997 | Guaron | 297/440.2 X |

*Primary Examiner*—Laurie K. Cranmer
*Attorney, Agent, or Firm*—Charles W. Chandler

[57] ABSTRACT

A wheelchair backrest and seat is mounted on chair tubes that form part of the wheelchair frame, using suspension hooks adapted to partially surround the chair tubes. Special abutment devices are slidably mounted on the chair tubes to prevent the hooks from shifting on the chair tubes. Each abutment device has a latch element that can be projected over the associated hook to prevent the hook from movement away from the chair tube.

5 Claims, 4 Drawing Sheets

WHEELCHAIR SEAT AND BACKREST CONSTRUCTION

BACKGROUND AND SUMMARY OF THE INVENTION

This invention relates to wheelchairs, and particularly to mechanisms for mounting the seat and backrest on a wheelchair, and also on adjustable solid bucks, and adjustable solid drop bases.

A backrest construction for a wheelchair is shown in U.S. Pat. No. 5,211,446 to E. C. Jay et al. The backrest mounting means comprises a flexible strap extending from a channel at one edge of the backrest around brackets carried by mounting posts on the wheelchair.

U.S. Pat. No. 5,524,971, issued to E. C. Jay et al shows a backrest that can be angularly adjusted to vary the backrest inclination angle.

The present invention relates to a wheelchair wherein the height of the seat can be adjusted, and the inclination angle of the backrest can be adjusted. The adjustments use quick release brackets that enable the adjustments to be made relatively quickly. Specific features of the invention will be apparent from the attached drawings and accompanying description of preferred structures constructed according to the invention.

DESCRIPTION OF THE DRAWINGS

The description refers to the accompanying drawings in which like reference characters refer to like parts throughout the several views, and in which:

FIG. 2 is taken in the direction of arrow 2 in FIG. 1.

FIG. 4 is taken in the direction of arrow 4 in FIG. 1.

DESCRIPTION OF A PREFERRED EMBODIMENT

Figure 1:
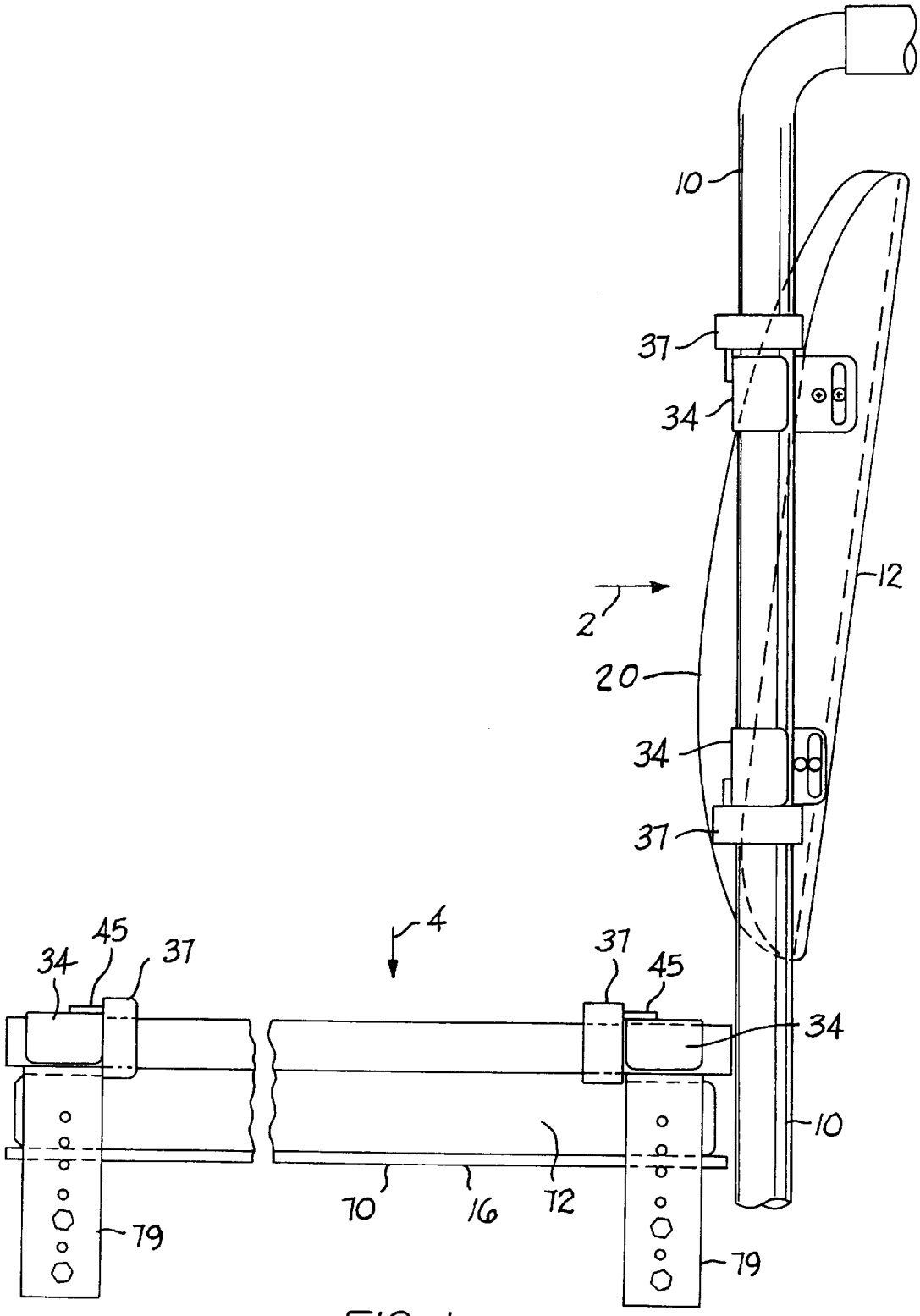
FIG. 1 is a fragmentary side elevational view of a wheelchair having a backrest and seat constructed according to the teachings of the invention.

FIG. 1, shows a wheelchair that includes two generally upright parallel chair tubes 10 for mounting a backrest 12, and two generally horizontal parallel chair tubes 14 for mounting a seat base 16. Each chair tube 10 or 14 can be formed out of steel, aluminum or other suitable material.

Figure 2:
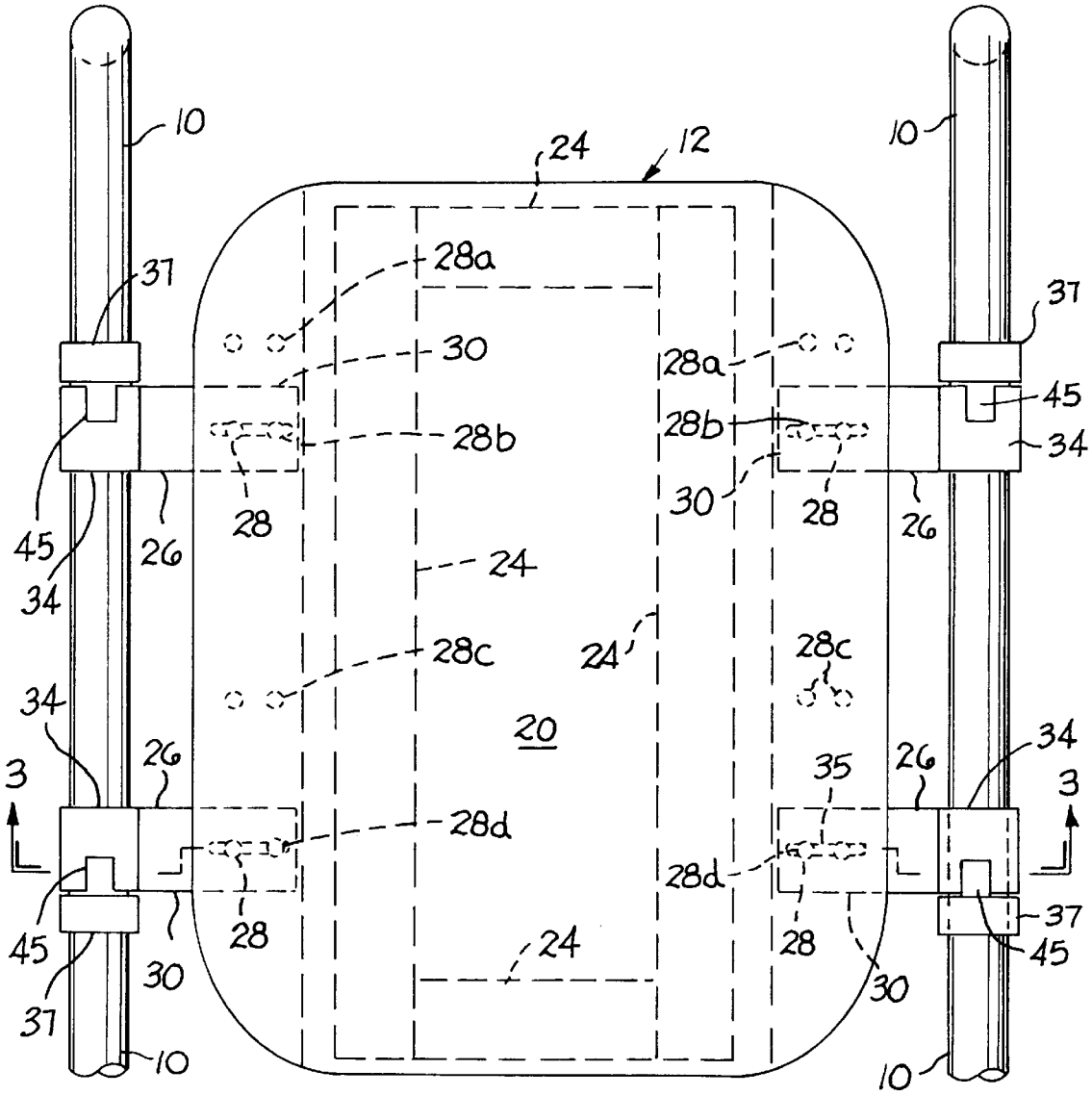
FIG. 2 is a front view of a backrest used in the FIG. 1 wheelchair.
Figure 3:
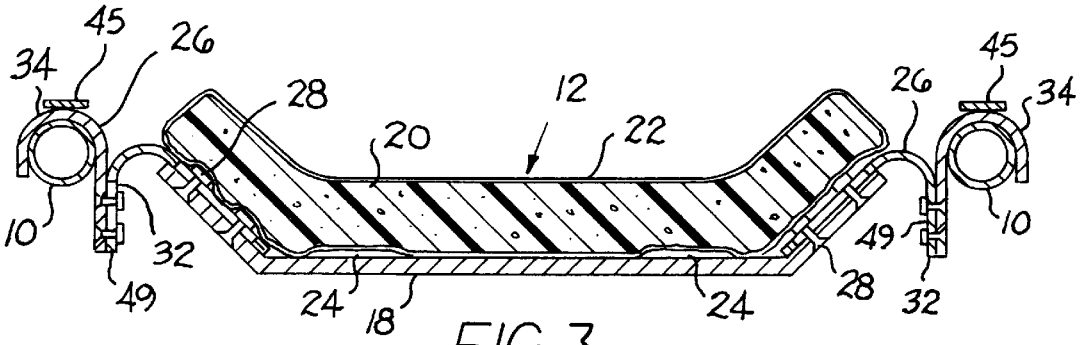
FIG. 3 is a sectional view taken essentially on line 3—3 in FIG. 2.

Backrest 12, as shown in FIGS. 2 and 3, comprises a rigid, concave shell 18 formed of metal or other high strength material, and a relatively soft resilient cushion 20 secured to the front concave surface of shell 18. The shell and cushion cooperatively form a body-support panel mechanism for supporting the back of the wheelchair occupant.

Cushion 20 preferably comprises a core material of resilient closed cell polyvinyl chloride (PVC) plastic foam material, and a woven cloth covering 22 around the resilient core. The cloth covering can have a hook and loop fastener or a zippered opening for removing the resilient core to wash or clean the cloth covering.

Cushion 20 is preferably releasably secured to shell 18 by means of fibrous hook fastener material, e.g. material marketed under the trademark VELCRO. As shown in FIG. 2, four rectangular strips 24 of the fibrous fastener material are secured to shell 18 for engaging the rear surface of cushion 10. The fastener material can lock with the cloth covering 22 or with mating strips of fibrous loop fastener material secured to the surface of covering 22.

Shell 18 has four similarly constructed angle members 26 secured thereto by nut-and-bolt assemblies 28. Each angle member 26 has a first leg 30 secured to shell 18 and a second leg 32 secured to an aluminum hook 34. Slots 35 in legs 30 permit angle members 26 to be adjusted in or out relative to the edges of shell 18, such that hooks 34 are located relatively close to or remote from the shell edges, depending on the slidable adjustments of angle members 26. The purpose of the slot 35 adjustments is to vary the hook 34 spacings to accommodate different spacings between chair tubes 10, whereby the backrest can be used on a range of different wheelchairs.

Figure 6:
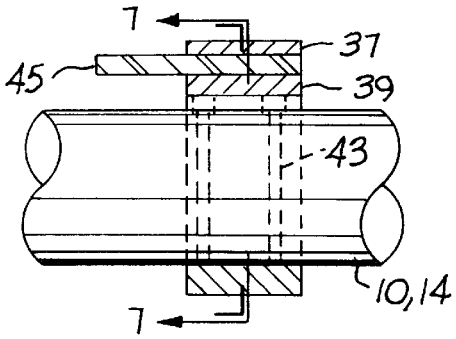
FIG. 6 is a sectional view taken through a clamping collar structure used in the FIG. 1 wheelchair to retain the back rest and seat in proper position.
Figure 7:
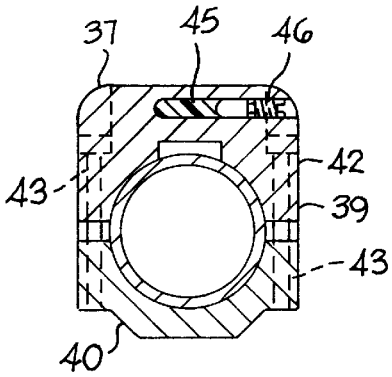
FIG. 7 is a transverse sectional view taken on line 7—7 in FIG. 6.
Figure 9:
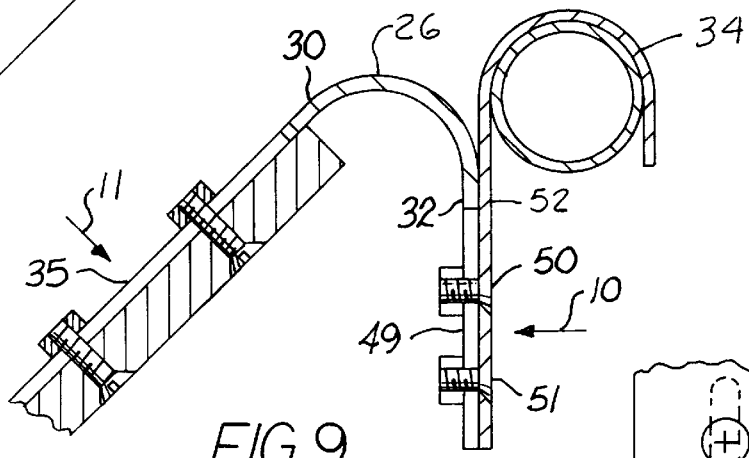
FIG. 9 is a fragmentary sectional view taken through a hook anchorage angle member employed to retain the FIG. 1 backrest in proper operating position.

Each hook extends partially around one of the chair tubes 10, as best shown in FIGS. 3 and 9. To prevent the hooks from shifting along the chair tubes, each chair tube is equipped with two similarly constructed abutments 37. FIGS. 6 and 7 show one form that each abutment can take.

Each abutment comprises a split collar 39 that includes two separate collar sections 40 and 42 joined together by four clamping screws 43. When the screws are tightened, the collar is clamped to chair tube 10 to prevent hooks 34 from shifting (sliding) along the chair tube. When screws 43 are slightly loosened, the collar can slide along chair tube 10 to a new position (corresponding to the position of hooks 34).

Figure 12:
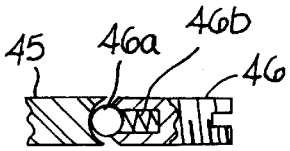
FIG. 12 is an enlarged sectional view of a typical detent.

Each split collar 39 carries a plate-type latch element 45 that can slide in a direction parallel to the collar axis. A set screw 46 is threaded into a hole in collar section 42. The end of the screw is hollow and carries ball element 46a raised by an internal spring 46*b*, as shown in FIG. 12. The ball detent slides in a longitudinal groove 47 in latch plate 45. When the screw is rotated toward the latch element, the ball detent is pushed into the screw end so that the screw engages the latch element to act as a stop to limit slidable movement of the latch element. When the screw is backed off, it disengages the latch element, permitting the ball detent to slidably engage the latch element, permitting it to be slidably adjusted.

Each latch element 45 is slidably adjustable between a retracted position out of registry with an associated hook 34, and an extended position overlying the hook. As shown in FIG. 2, latch elements 45 in their extended positions lock hooks 34 against movement away from chair tubes 10. When latch elements 45 are retracted out of registry with hooks 34, backrest 12 can be swung from chair tubes 10

(since hooks 34 are no longer restrained by latch elements 45. Set screws 46 are tightened to lock latch elements 45 in position.

Backrest 12 can have a range of different angulations and seat depths, e.g. relatively upright as shown in FIG. 1, tilted rearwardly, tilted forwardly, or moved forward or rearward with no angle in the upright position. This angulation adjustment is made possible by changing the locations of hooks 34 along the vertical dimension of the backrest. As shown in FIG. 2, two rows of nut-bolt assemblies 28 extend along the edge areas of shell 18. Each nut-bolt assembly constitutes a potential anchorage point for one of the hooks 34. However, only two of the anchorage points in each row are used at any one time.

As viewed in FIG. 2, each row of anchorage points contains four anchorage points 28*a*, 28*b*, 28*c*, and 28*d*. In the FIG. 2 arrangement, anchorage points 28*b* and 28*d* are used. To incline the backrest rearwardly, anchorage points 28*c* and 28*d* are used.

Figure 11:
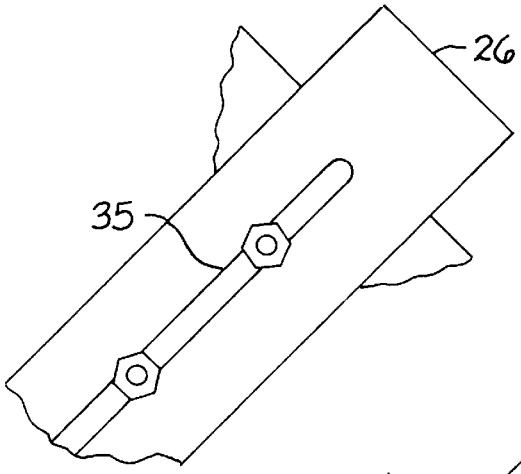
FIG. 11 is a fragmentary view taken in the direction of arrow 11 in FIG. 9.

The angle of inclination of backrest 12 can be further varied by adjusting the relative positions of each angle member 26 (FIG. 11) and hook 34. Referring to FIGS. 3 and 9, leg 32 of each angle member 26 has a slot 49 accommodating the bolts that extend through leg 52 of hook 34. Slot 49 permits hook 34 to be adjusted forwardly or rearwardly relative to the plane of the backrest, so as to vary the inclination angle of the backrest.

Figure 10:
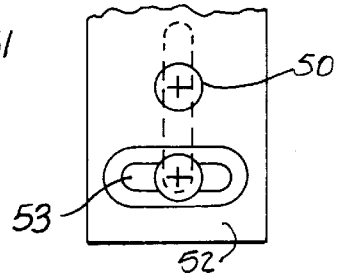
FIG. 10 is a fragmentary view taken in the direction of arrow 10 in FIG. 9.

As shown in FIGS. 9 and 10, two screws (bolts) 50 and 51 connect leg 32 of angle member 26 to hook 34. The lower screw 51 extends through a transverse slot 53 in hook 34, such that the hook can swing around the upper screw 50 to enable the hook to better conform to the surface of chair tube 10 in any adjusted position of the backrest.

Chair tubes 10 enable the backrest to have a range of different inclinations. Chair tubes 10 also permit the backrest to be adjusted vertically, i.e. by sliding hooks 34 along the chair tubes. Abutments 37 are adjusted accordingly.

Figure 4:
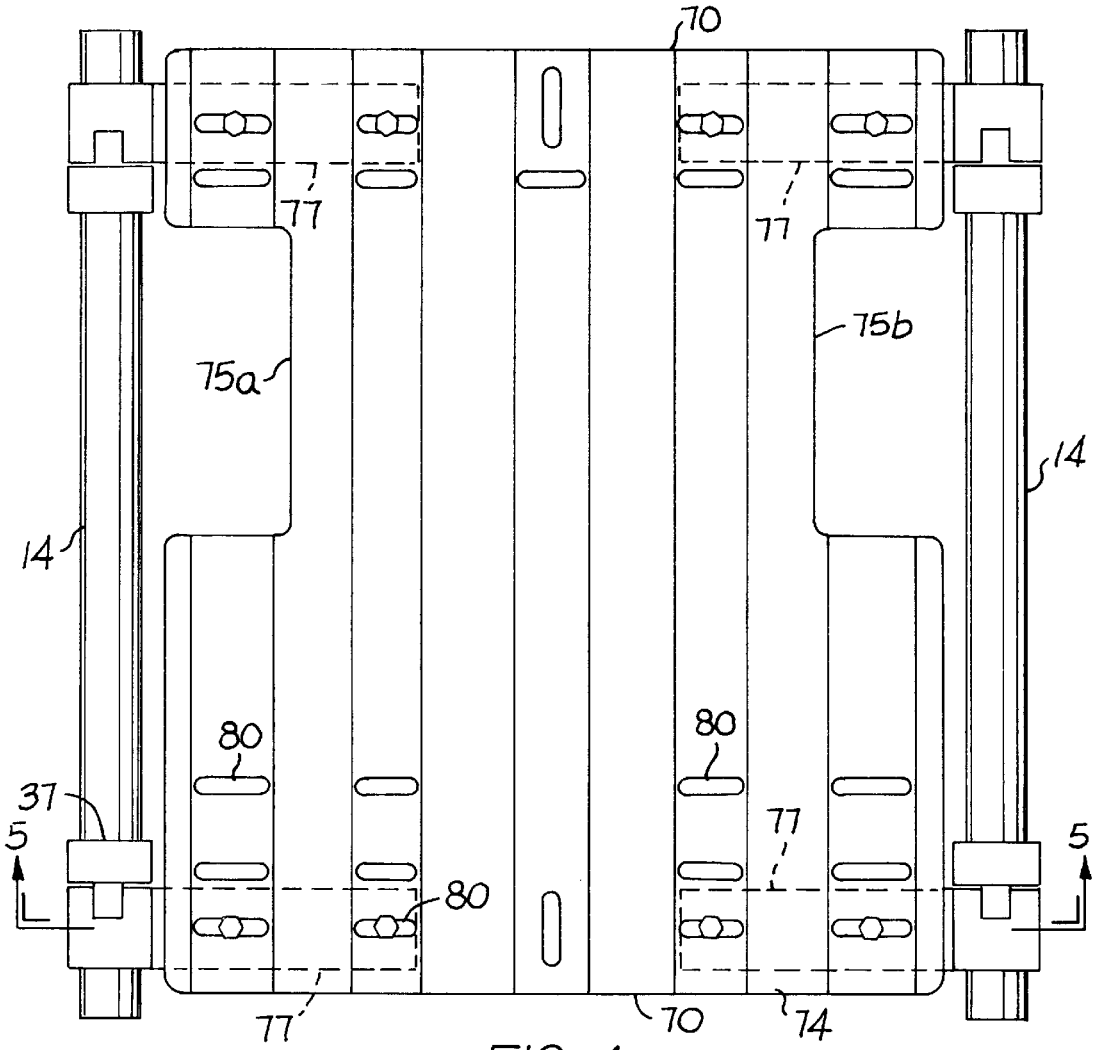
FIG. 4 is a top plan view of a ribbed seat used in the FIG. 1 wheelchair.
Figure 5:
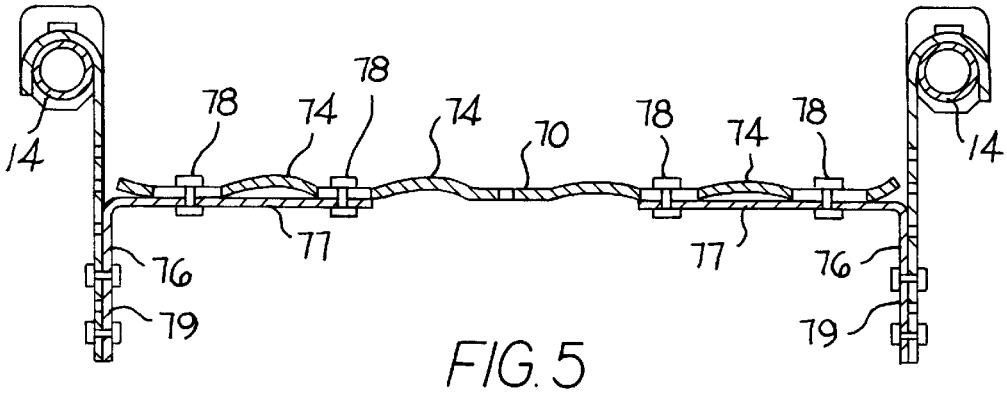
FIG. 5 is a sectional view taken on line 5—5 in FIG. 4.
Figure 8:
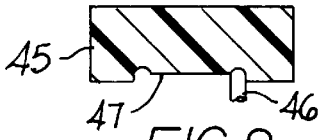
FIG. 8 is a sectional view taken through a latch element used in the FIG. 6 clamping collar.

The abutment-hook relationship can be applied to seat 16, as well as backrest 12. As shown in FIGS. 1, 4 and 5, the seat comprises a rigid metal seat plate 70, preferably of aluminum about 5/32" thick, and a seat cushion 72 suitably supported on the plate. The plate and cushion cooperatively form a body support panel, i.e. a seat.

As shown in FIG. 5, seat plate 70 has four shallow reinforcing channels 74 parallel to the side edges of the seat plate. Each reinforcing channel has a relatively low height, that is, it is vertically offset from the plane of the seat a distance generally corresponding to the plate thickness. Each channel extends the full depth of the seat plate whereby the plate is essentially flat while still having the desired rigidity, due to the presence of the reinforcing channels. The seat plate has rectangular openings 75*a* and 75*b* which accommodate the conventional frame members (not shown) of a wheelchair.

Seat plate 70 is attached to hooks 34 by means of four angle members 76. Each angle member comprises a horizontal leg 77 attached to the plate by suitable nut-bolt assemblies 78, and an integral vertical leg 79 attached to the associated hook 34 by additional nut-bolt assemblies.

Transverse slots 80 in plate 70 enable each pair of hooks 34 to be spaced different distances apart, to accommodate the seat to different distances between tubular guides 14. Slots 80 are disposed in the seat plate between channels 74. Each vertical leg 79 has several bolt holes, whereby plate 70 can be raised or lowered relative to chair tubes 14.

The channel or ribbed aluminum seat plate provides special advantages over conventional plastic seat components having deep ribs because accessories can be more easily attached to a ribbed plate having a shallow vertical dimension.

It will be seen that the hook 34-abutment 37 relationship can be used with the backrest and/or with the seat, to permit quick replacement of the seat or backrest on different wheelchairs having different guide structure spacings. The invention permits the seat and/or backrest to have different types of adjustments, to meet individual needs and preferences.

What is claimed:

1. In a wheel chair having two parallel chair tubes and a backrest locatable between said chair tubes; the improvement comprising two hooks extending from said backrest over each of said chair tubes, two rows of hook anchorages on said backrest, each row comprising at least three anchorages; said hooks being selectively mounted at different ones of said anchorages, to vary the inclination of the back rest, each anchorage comprising an angle member having a first leg securable to the backrest and a second leg securable to an associated hook.

2. In a wheelchair having two parallel upstanding chair tubes, and a backrest supportable between said chair tubes;

the improvement comprising:

said backrest comprising a concave rigid shell having a concave front surface, and a cushion mounted on said concave front surface;

two hooks extending from said rigid shell partially around each upstanding chair tube;

two abutments slidable on each chair tube to prevent said hooks from shifting along said chair tubes, and a latch element projectible from each abutment over an associated hook, whereby said hooks are prevented from displacement away from the chair tubes;

said rigid shell having two rows of hook anchorages;

each of said rows comprising at least three anchorages;

said hooks being selectively mounted at different ones of said anchorages to vary the inclination of said backrest; and wherein each of said anchorages comprises an angle member having a first leg securable to said rigid shell and a second leg securable to an associated hook.

3. The improvement of claim 2, wherein there are four anchorages in each row of anchorages.

4. The improvement of claim 2, and further comprising an adjustable attachment means joining each said hook to the second leg of each associated angle member;

each said attachment means comprising a first linear slot (49) in each respective second leg, and first and second threaded fasteners (50, 51) extending from each respective hook through the associated linear slot;

each hook having a second slot extending transverse to said first linear slot in intersecting relationship;

each said second threaded fastener extending through said second transverse slot so that said hook is swingably adjustable around said first threaded fastener.

5. In a wheelchair having two parallel upright chair tubes, a backrest locatable between said chair tubes, and two parallel horizontal chair tubes; the improvement comprising a generally planar rigid metal seat plate, and connector means for adjustably connecting said metal seat plate to said horizontal chair tubes so that said seat plate has a horizontal disposition between said chair tubes; said seat plate having a front edge, two side edges, and a rear edge; said seat plate having a series of integral shallow reinforcing channels extending from said front edge to said rear edge parallel to said side edges; each of said reinforcing channels having a height dimension and a width dimension; the width dimension of each of said reinforcing channels being appreciably greater than the height dimension; each of said reinforcing channels having an arcuate cross section offset upwardly from the plane of said seat plate; the height dimension of each said reinforcing channel being approximately the same as the thickness of said seat plate; said connector means comprising a first set of slots (80) in said seat plate proximate to the front edge of said seat plate and a second set of slots (80) in said seat plate proximate to the rear edge of said seat plate, each of said slots extending parallel to the front and rear edges of said seat plate; said connector means further comprising four angle members (76) adjustably attached to said seat plate at said slots; each of said angle members having a horizontal leg (77) adjustably attached to said plate via one of said slots, and a downwardly extending vertical leg (79); said connector means further comprising a hook (34) adjustably attached to the vertical leg of each of said angle members; said hooks extending upwardly above the plane of said seat plate for partial encirclement around said horizontal chair tubes.

* * * * *